US009417652B2

(12) United States Patent
Hecht et al.

(10) Patent No.: US 9,417,652 B2
(45) Date of Patent: Aug. 16, 2016

(54) BEVERAGE DISPENSING APPARATUS WITH LEVER ASSEMBLY

(71) Applicant: Automatic Bar Controls, Inc., Vacaville, CA (US)

(72) Inventors: Thomas R. Hecht, Winters, CA (US); Richard A. Martindale, Vacaville, CA (US); Bret D. Baker, Vacaville, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 14/331,140

(22) Filed: Jul. 14, 2014

(65) Prior Publication Data

US 2016/0009538 A1 Jan. 14, 2016

(51) Int. Cl.

| | |
|---|---|
| ***B67D 1/00*** | (2006.01) |
| ***G05G 1/04*** | (2006.01) |
| ***G05G 5/04*** | (2006.01) |
| *B67D 1/12* | (2006.01) |

(52) U.S. Cl.

CPC ..... *G05G 5/04* (2013.01); *B67D 1/0084* (2013.01); *G05G 1/04* (2013.01); *B67D 1/00* (2013.01); *B67D 1/0042* (2013.01); *B67D 1/0086* (2013.01); *B67D 1/1286* (2013.01); *B67D 2001/0087* (2013.01); *B67D 2001/0089* (2013.01); *B67D 2210/0006* (2013.01); *Y10T 137/87684* (2015.04)

(58) Field of Classification Search

CPC ..... B67D 2001/0087; B67D 2210/0006; B67D 1/00; B67D 1/0086; B67D 1/0042; B67D 1/0084; B67D 2001/0089; B67D 1/1286; G05G 1/04; G05G 5/04

See application file for complete search history.

(56) References Cited

U.S. PATENT DOCUMENTS

| | | | | |
|---|---|---|---|---|
| 4,619,378 | A * | 10/1986 | de Man | B67D 1/0049 137/607 |
| 4,986,449 | A | 1/1991 | Valiyee et al. | |
| 8,177,100 | B2 * | 5/2012 | Salmela | B67D 1/0084 137/606 |
| 8,814,003 | B2 * | 8/2014 | Santy | B67D 1/0021 222/144.5 |
| 9,010,579 | B2 * | 4/2015 | Baker | B67D 1/0086 222/129.1 |
| 2009/0114680 | A1 * | 5/2009 | Williams | B67D 1/0021 222/144.5 |
| 2011/0315711 | A1 | 12/2011 | Hecht et al. | |

* cited by examiner

*Primary Examiner* — Frederick C Nicolas

(74) *Attorney, Agent, or Firm* — Kilpatrick Townsend & Stockton LLP

(57) ABSTRACT

A beverage dispensing apparatus including a lever assembly where the lever assembly has a base and a at least one elongated arm. The base has a bottom configured to mate with a beverage dispensing device, a top side opposite the bottom and apertures penetrating the base from top to bottom configured to align with buttons on the beverage dispensing apparatus. The at least one elongated lever has a top surface, a bottom surface, a first end and a second end configured to extend away from the centerline of the beverage dispensing apparatus. When the lever assembly is installed on a beverage dispensing device, buttons extending from the top of the beverage dispensing device extend up through the apertures and pressed against the bottom surface of the at least one elongated lever, biasing the at least one lever upward and the when the lever is pressed, it pushes against the button of the beverage dispensing apparatus to dispense a beverage.

8 Claims, 7 Drawing Sheets

BEVERAGE DISPENSING APPARATUS WITH LEVER ASSEMBLY

BACKGROUND

The invention relates to a lever assembly for a beverage dispensing system. Particularly, the invention relates to a lever assembly that can be installed on a tower beverage dispensing system or a hand-held beverage dispenser, also known as a bar gun, to provide greater control and leverage in operating valves utilized by the beverage dispensing system for controlling the dispensing of a beverage.

Beverage dispensing systems are commonly used in a wide variety of locales, including restaurants, snack bars, convenience stores, movie theaters, and any business where beverages are served. These beverage dispensing systems often dispense a variety of beverages of differing types and flavors, such as flavored carbonated sodas, iced tea, water, or even alcoholic beverages. These devices dispense the variety of beverages either by dispensing a single component beverage or by utilizing a dispensing array, also referred to as a diffuser, through which a single beverage may pass or a base beverage and a beverage additive, flow to a dispense point that facilitates discharge of beverages or beverage additives. The beverage components are then dispensed through a dispensing nozzle into a beverage container.

Some beverage dispensing systems are in the form of a beverage tower while others use a hand-held beverage dispensing handle, commonly referred to as a bar gun. The bar gun uses a single nozzle for dispensing multiple different beverages depending on the needs of the end user. A tower system can have a single nozzle or multiple nozzles for dispensing a beverage. When a single nozzle tower is used, it can be configured to dispense a variety of different beverages using valves in connection with a manifold and system of fluid lines connected to beverage sources for distributing a mixed or single component beverage through a nozzle. Buttons can be used to activate the valves to control the flow of the beverage from the system. The same concept is used with bar guns except that the buttons and valves are located in the bar gun itself rather than in the beverage tower dispenser. The beverage dispensers utilizing this concept have at least one button, and often numerous buttons, for controlling the dispensing of a single beverage component or a mixed beverage into a container.

Some perceive the buttons used on the described beverage dispensers to have some disadvantages because the buttons mechanically activate the valves of the beverage dispensing system. According to some operators, the buttons seem small and may fill with overspray from the beverage itself, causing them to get sticky and harder to depress with prolonged use. Some operators consider the buttons to lack any mechanical advantage because the force needed to open the valves is the same force required to operate the button. With prolonged use, some operators find operating the bar gun or tower assembly more difficult.

Accordingly, it is desirable to develop an assembly that can easily be installed on a bar gun or tower beverage dispensing device to make dispensing beverages easier.

BRIEF SUMMARY OF THE INVENTION

The present invention is related to beverage dispensing lever assemblies, and more specifically to beverage dispensing lever assemblies that are configured to be installed on a bar gun or tower beverage dispensing device, providing levers that depress buttons that exist on the bar gun and beverage dispensing tower for activating valves for dispensing a beverage.

One embodiment is related to a beverage dispensing apparatus including a lever assembly where the lever assembly has a base and at least one elongated arm. The base has a bottom configured to mate with a beverage dispensing device, a top side opposite the bottom and apertures penetrating the base from top to bottom configured to align with buttons on the beverage dispensing apparatus. The at least one elongated lever has a top surface, a bottom surface, a first end and a second end configured to extend away from the centerline of the beverage dispensing apparatus. When the lever assembly is installed on a beverage dispensing apparatus, buttons extending from the top of the beverage dispensing apparatus extend up through the apertures, pressing against the bottom surface of the at least one elongated lever, biasing the at least one lever upward and the when the lever is pressed, the lever pushes against the button of the beverage dispensing apparatus to dispense a beverage.

In some aspects the lever assembly can have two pin mounts and in some aspects can have a pin extending between the two pin mounts. In some embodiments the second end of the lever is configured to mate with and rotate about a pin.

In some embodiments the lever assembly can comprise a rotation stop arm extending from the top surface at the second end of the lever. The lever assembly can also have a stop surface aligned across from and coordinating with the rotation stop arm, wherein the biasing of the lever upward and about the pin is limited by the rotation stop arm contacting the stop surface. The at least one elongated lever may also be configured at its second end to coordinate and mate with one additional elongated lever and where the stop surface of each elongated lever is the top surface of the other elongated lever.

In some aspects the levers are configured to extend transverse to the length of the bar gun. In other embodiments the levers are configured to extend parallel to the length of the bar gun.

Further understanding of the nature and the advantages of the embodiments disclosed and suggested herein may be realized by reference to the remaining portions of the specification and the attached drawings.

DETAILED DESCRIPTION OF THE INVENTION

Embodiments of the invention are generally directed to beverage dispenser lever assemblies, and more specifically to lever assemblies that engage and depress buttons on a bar gun or tower beverage dispensing device.

Embodiments of the lever assembly in accordance with the present invention are configured so that the lever assembly can be installed as part of the original beverage dispensing tower or hand held beverage dispenser or the level assembly can be installed on a pre-existing bar gun or tower beverage dispenser as a retro fit kit. In a circumstance such as upgrading with a retrofit kit, the button plate assembly, described herein, is removed and can be replaced by the lever assembly using the existing screw positions of the hand held beverage dispenser.

Hand held beverage dispensers, which allow an operator to dispense a number of different beverages by merely pressing an appropriate button on the dispenser, have been around for many years. One exemplary bar gun is as described in Assignees pioneering patent, U.S. Pat. No. 4,986,449 to Valiyee, the entirety of which is incorporated herein by reference. An exemplary tower is described in Assignees patent application, U.S. Application No. US2011/0315711 A1 to Hecht. Other similar bar guns and towers are commercially available from Automatic Bar Controls at www.wunderbar.com.

Figure 1:
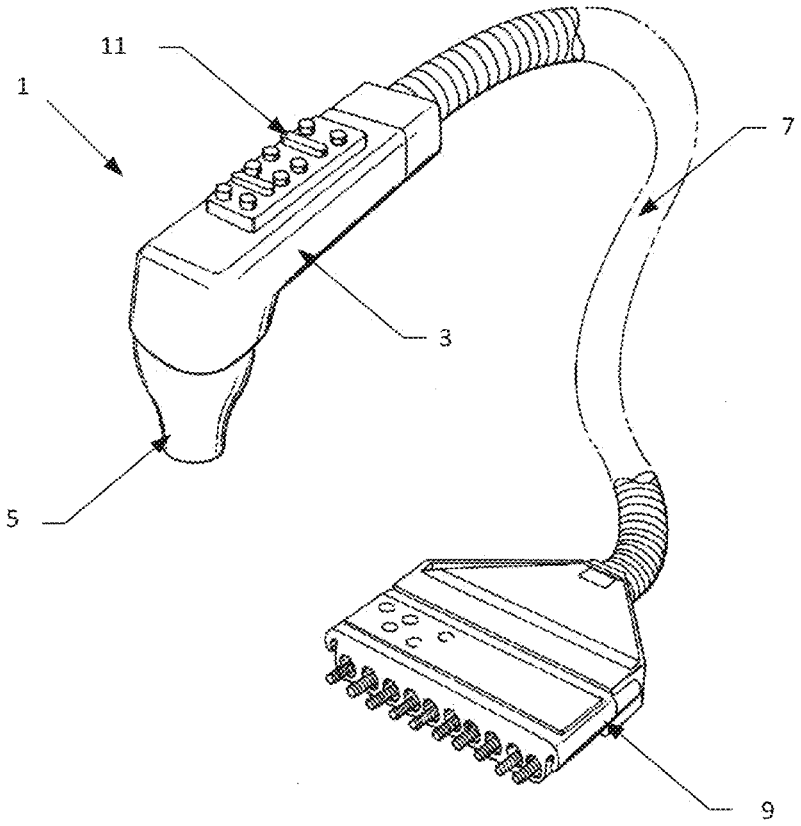
Prior Art FIG. 1
FIG. 1 is a perspective view of a hand held beverage dispenser in accordance with the prior art.

Regarding a bar gun, as seen in Valiyee and illustrated in FIG. 1, the bar gun 1 has a handle 3 that has a nozzle 5 at one end for dispensing the beverage. At the other end, the handle 3 is connected to a flexible line 7 that connects to a brixing device 9 that contains shut off and flow valves for controlling the flow of beverage components to the bar gun. The brixing device 9 is in turn connected to a beverage source (not shown). The bar gun, also has buttons 11 on the handle 3 that activate valves for dispensing a single beverage component or a mixed beverage solution depending on the button 11 pushed by the operator and the configuration of the bar gun 1. Beverage dispensing towers can be configured similarly with a nozzle, a tower, dispensing and flow control valves and buttons for dispensing the beverage, except the buttons are installed on the fixed tower assembly rather than on the handle of a hand held bar gun.

The buttons on a bar gun handle or a tower beverage dispenser allow an operator to select particular beverage components and/or dispense the beverage components in predetermined or customizable flow rates and volumes. These buttons can be numerous, or merely be a single button, depending on the intend use of the operator or establishment utilizing the bar gun or tower. In use, the lever assembly according the present invention can be installed on a tower beverage dispensing device or a bar gun, which is connected to a beverage dispensing system, such as the one described above.

The above aspects of the invention can be further understood with reference to the exemplary devices shown in FIGS. 2-10, although the invention is not limited to the depicted embodiments and may include many variations in accordance with the principles and aspects described herein.

Figure 2:
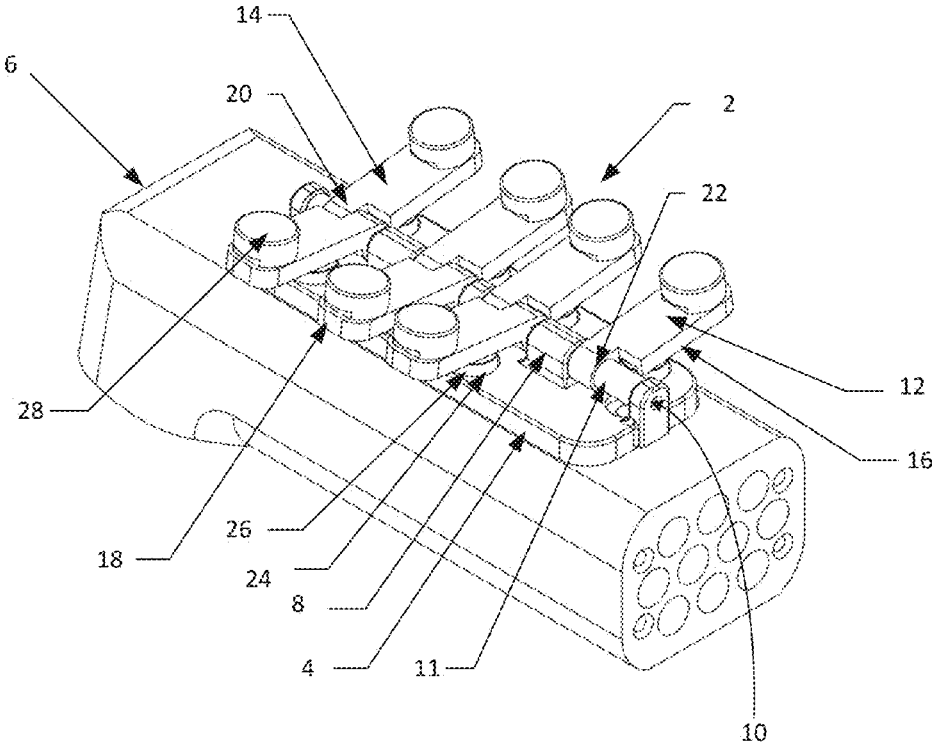
FIG. 2 is a perspective view of a hand held beverage dispenser with a lever assembly.

FIG. 2 shows one embodiment of the lever assembly 2 having a base 4 that extends along the length of a bar gun 6. Pin mounts 8 are formed in the base 4 and hold a pin 10 that extends along the base 4. In this particular embodiment the pin mounts 8 extend upward from the base 4 to suspend the pin above the top surface of the base 4. The pin 10 generally runs along the center line of the base 4. The pin 10 can be surrounded by a spacer 11 for aligning the levers along the pin 10 as see in FIGS. 1-5. The pin 10 can be seen penetrating the spacer 11 in FIG. 6. Elongated levers 12 each have a top surface 14, a bottom surface 16, a first end 18 and a second end 20. The second end 20 has a pin aperture 22 that extends through the lever 12 transverse with the length of the lever 12 that is sized and configured to mate with the pin 10 such that the lever 12 can rotate about the pin 10.

Figure 10:
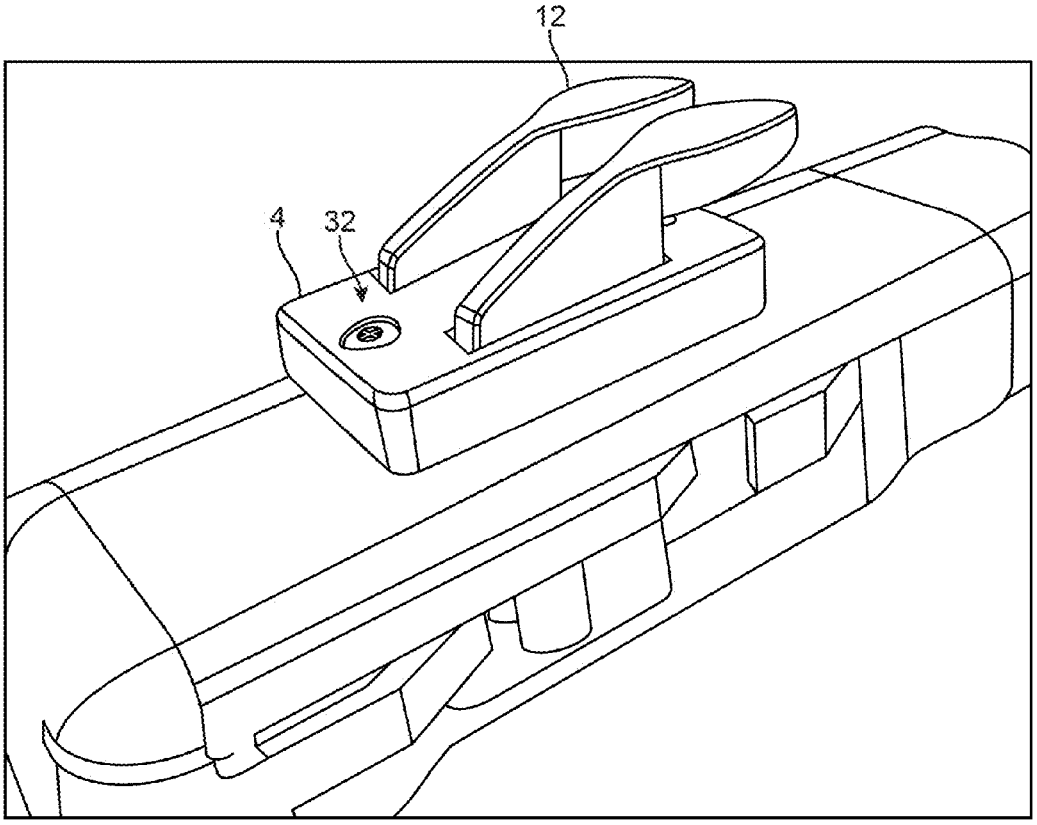
FIG. 10 is a perspective view of an additional embodiment of a hand held beverage dispenser handle with a lever assembly where the levers align parallel with the length of the handle.

As can be seen in this embodiment, the pin 10 extends generally parallel with the length of the bar gun 6. The levers 12 however extend transverse to the length of the bar gun and outward so a user presses on the first end 18 of the levers 12 toward the outer edges of the bar gun 6. Other embodiments, discussed below and better seen in FIG. 10, show the pin 10 extending transverse to the bar gun length with the levers 12 extending generally parallel to the bar gun length in a direction such that when a bar gun 6 is being held in by a user the levers 12 extend back toward the users arm.

The base 4 of the lever assembly 2 has at least one aperture 24, that is shaped to accept a bar gun button 26 extending upward from the bar gun 6. The bar gun buttons 26 are biased upward by a spring (not shown) in the bar gun 6 when the valve of the bar gun 6 is closed and thus blocking flow of beverage through the fluid beverage lines of the bar gun 6. In turn the bar gun buttons 26, bias the levers 12 upward a predetermined distance and rotationally about the pin 10. The bar gun button is prevented from falling out of the base 4 by the button top. In this case retaining rings (not shown) snap on the tops of the buttons 26, which fit under the levers 12. It is also possible for the base 4, to be an integral part of the bar gun and house the bias springs and other components of the bar gun.

Figure 3:
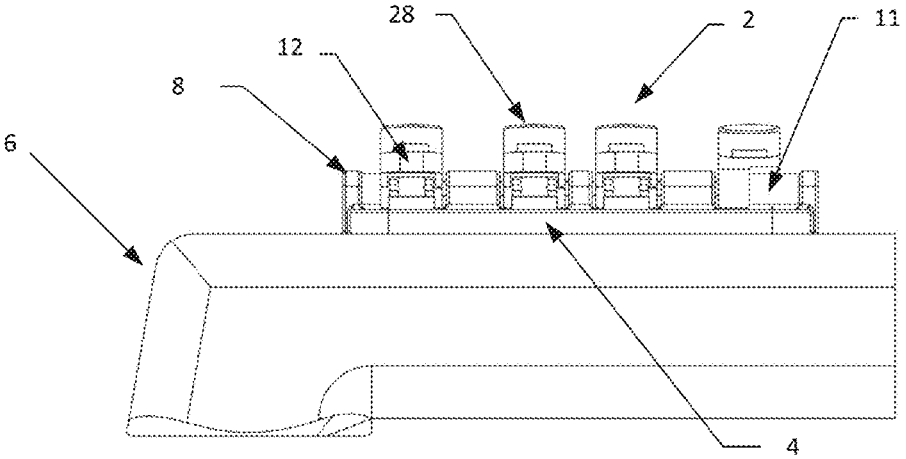
FIG. 3 is a side view of the assembly of FIG. 2.
Figure 4:
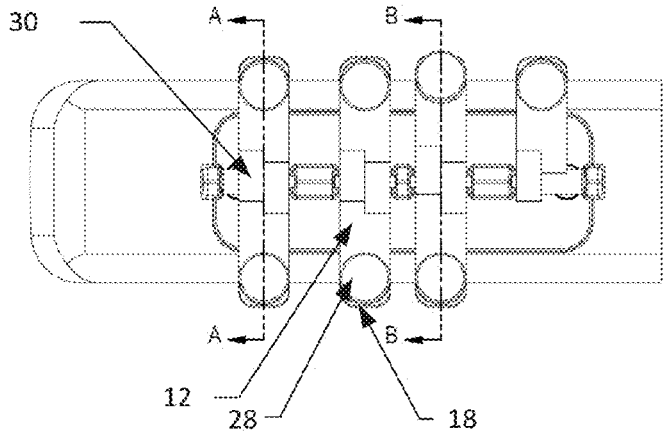
FIG. 4 is a top view of the assembly of FIG. 2.

FIGS. 2-4 show caps 28 installed on the first end 18 of lever 12 to make manipulating the levers 12 easier for a user. FIG. 3 shows a side view of the lever assembly of FIG. 2 and illustrates the pin 10 suspended above the base 4 and the levers 12 installed on the pin 10. FIG. 4. shows an additional embodiment of the lever assembly 2 with rotation stop arms 30. Here, the levers 12 extending transverse to the length of the bar gun 6 with the caps 28 on the first ends 18 of the levers 12. Also illustrated is the use of one pin 10 for multiple levers 12. While seven levers 12 are shown here, any number of combinations of levers 12 can be used in the lever assemblies 2. Rotation stop arms 30 are further shown and illustrated in FIG. 5, discussed below.

Figure 5:
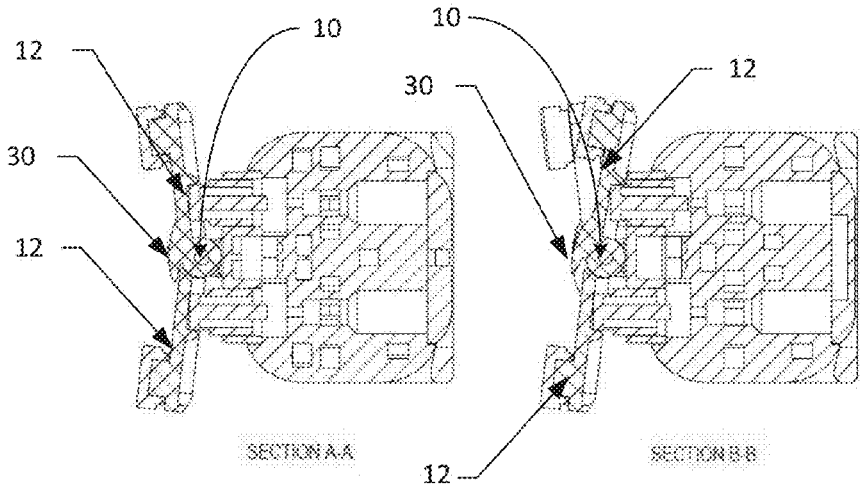
FIG. 5 illustrates two sectional views, A-A and B-B as Shown in FIG. 2, where one lever of the lever assembly is shown in an non-depressed state in A-A and in a depressed state in B-B.
Figure 6:
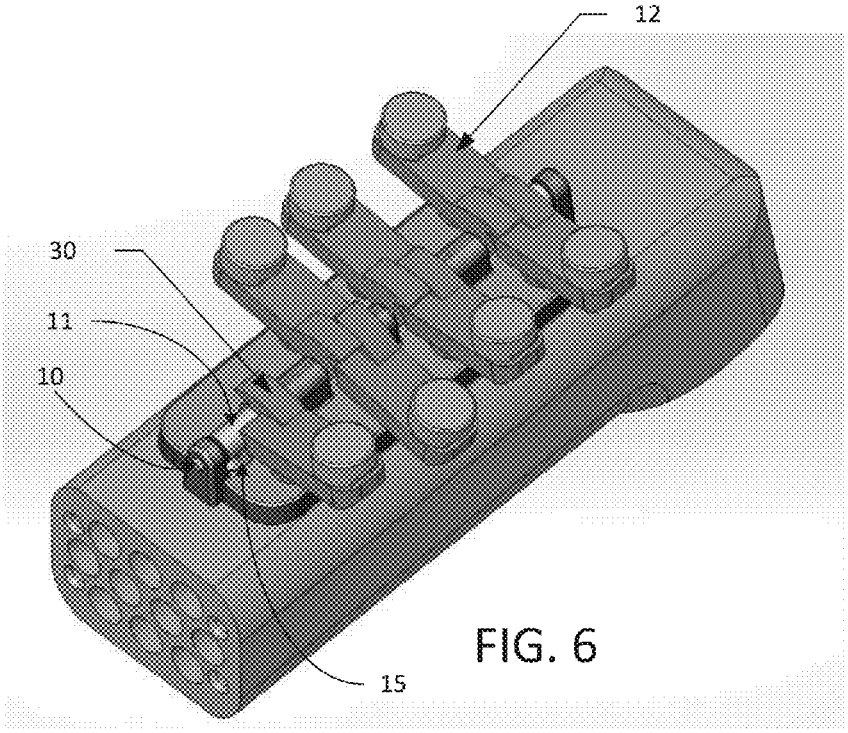
FIG. 6 is a perspective view of an additional embodiment of a beverage dispenser with a lever assembly.

FIG. 5 shows an additional embodiment with two cross sectional views of the lever assemblies 2 in accordance with the present invention. Section A-A illustrates the levers 12 of the lever assembly 2 in an non-depressed state where the buttons of the bar gun 6 bias all the levers 12 upward and all the valves of the bar gun 6 prevent fluid from being dispensed from the bar gun 6. Section B-B illustrates a state where one lever 12 is shown in a depressed state, pushing the respective bar gun button 26 downward against a biasing spring (not shown) and opening a valve inside the bar gun 6 to allow a beverage component to be dispensed from the bar gun 6. Rotation stop arms 30 extend from the second end 20 of the levers 12. As seen in section A-A, the rotation stop arm 30 rests against the top surface 14 of a lever 12 located opposite the first lever 12 with respect to the pin 10. In this non-depressed state, the rotation stop arm 30 prevents the lever 12 from rotating about the pin 10 beyond a predetermined position. Fasteners 15 are used in this embodiment to fasten the base 4 to the gar gun 6 as best illustrated in FIG. 6.

Figure 8:
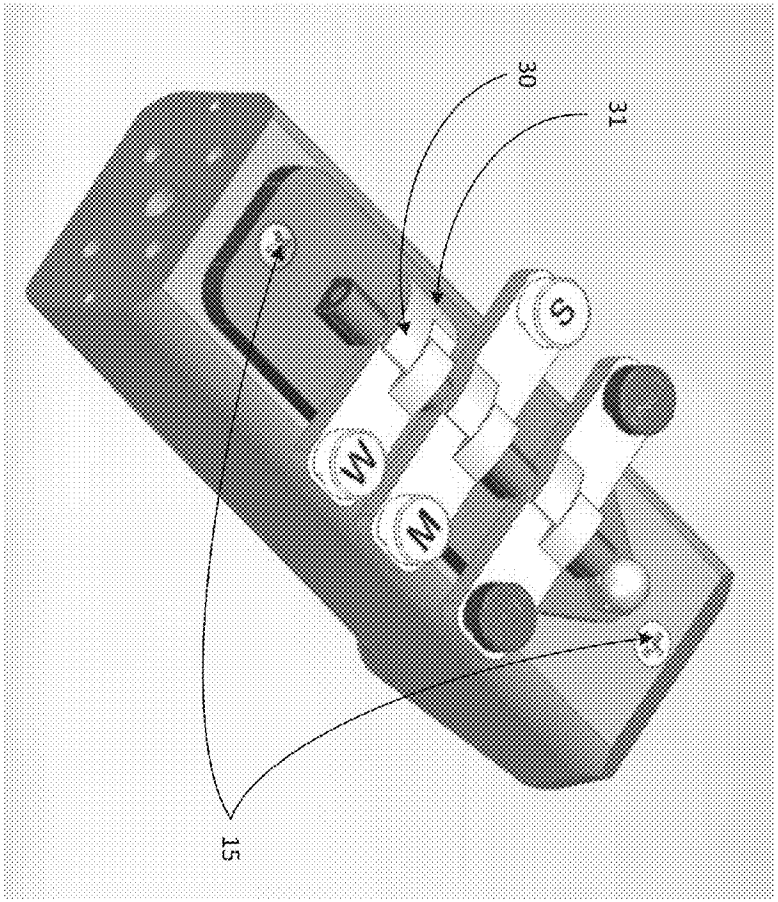
FIG. 8 is a perspective view of an additional embodiment of a hand held beverage dispenser with a lever assembly showing a stop arm spacer.
Figure 9:
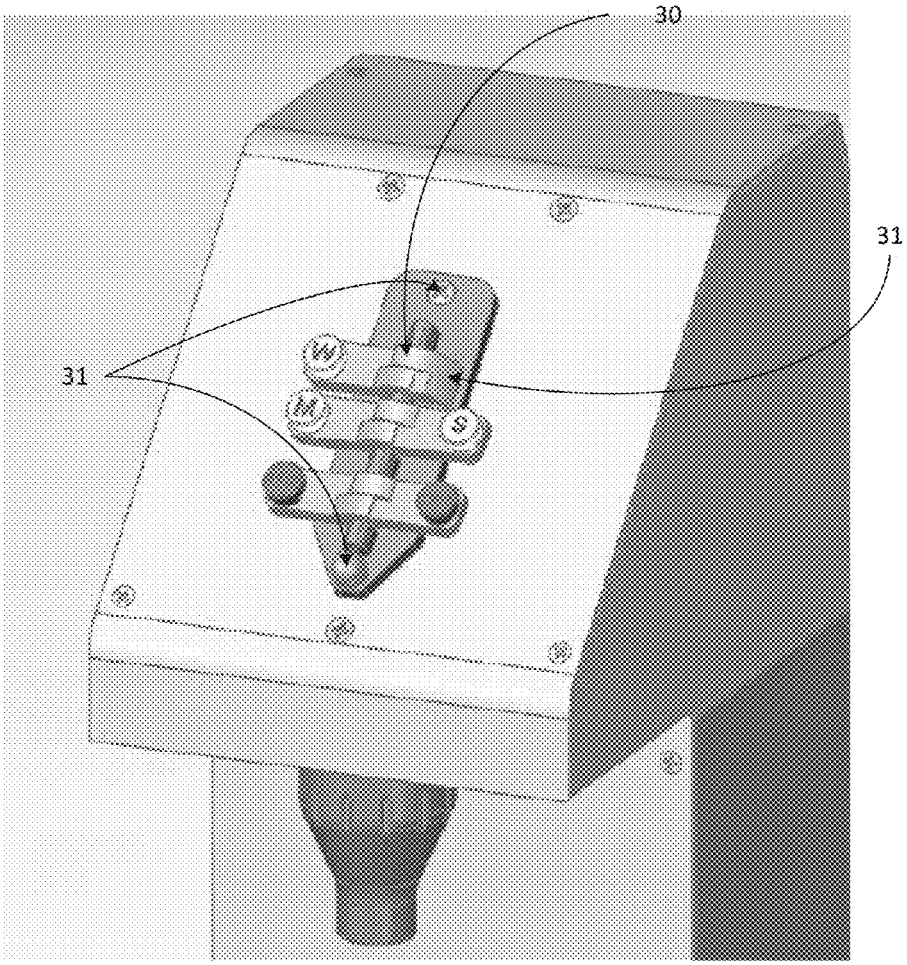
FIG. 9 is a perspective view of an additional embodiment of a beverage dispenser tower with a lever assembly showing a stop arm spacer.

The rotation stop arms 30 can be a separate components or integrated into the lever 12 itself as shown in FIGS. 4-7. The rotation stop arm 30 can also be an integrated or a separately attached component to a stop arm spacer 31, which is not a lever but performs the function of actin like spacer 11 and in conjunction with the stop arm 30, it prevents the lever 12 opposite the stop arm spacer 31 from rotating beyond a predetermined point. The stop arm spacer 31 is illustrated in FIG. 8 and FIG. 9.

Section B-B of FIG. 5 shows a gap between the rotation stop arm 30 and the top surface 14 of the opposite lever 12, indicating the lever 12 is depressing the bar gun button 26 downward, illustrating a position of when an operator is pushing the lever down to dispense a beverage component.

Figure 7:
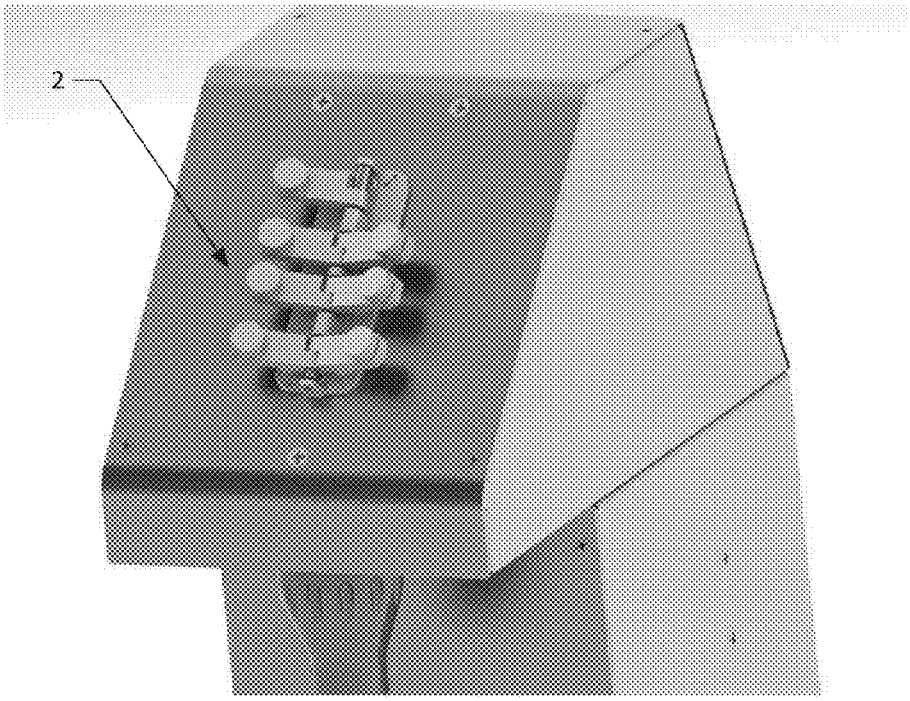
FIG. 7 is a perspective view of beverage dispensing tower with a lever assembly.

FIG. 7 is a perspective view of the lever assembly 2 of FIG. 4 and illustrates the rotation stop arms 30, and the levers 12 in both a depressed state, in the case of one lever 12, and a non-depressed state, in the case of the remaining levers 12.

FIG. 7 is a perspective view of an additional embodiment of a lever assembly 2 in accordance with the present invention but with the lever assembly 2 installed on a beverage tower assembly rather than a bar gun of the previously described embodiments. The lever assembly 2 is identical to previously described embodiments and can be installed as an original part of a beverage dispensing tower or bar gun or can be supplied as a kit to retrofit pre-existing beverage dispensing towers and bar guns given the configuration of the lever assemblies.

FIG. 8 and FIG. 9 respectively show perspective views of an additional embodiment of a hand held beverage dispenser and beverage dispensing tower with a lever assembly showing a stop arm spacer 31 and stop arm 30 in the lever assembly in accordance with many embodiments of the present invention. The fasteners 15 shown in this embodiment are shown outside the extents of pin 10. In this embodiment, the location of the fasteners allow for quicker removal of the entire lever assembly from the bar gun which depending on the circumstances, may be more desirable to the user, and can make maintenance easier.

FIG. 10 is a perspective view of an additional embodiment of a lever assembly 2 in accordance with the present invention. This embodiment illustrates two levers 12 extending parallel to the bar gun length back towards a bar gun user so the levers 12 are easily manipulated. One lever could be used or more than two levers could also be utilized in the lever assembly. This embodiment also shows the pin mounts 8 being formed down in recesses 32 of the base with the pin being suspended below the upper surface of the base 4. Instead of caps 28, the levers 12 have a flared shape at their first end 18 to make manipulating the levers 12 easier.

The above description is illustrative and is not restrictive. A recitation of "a", "an" or "the" is intended to mean "one or more" unless specifically indicated to the contrary. Many variations of the disclosure will become apparent to those skilled in the art upon review of the disclosure. One or more features from any embodiment described herein may be combined with one or more features of any other embodiment without departing from the scope of the disclosure. The scope of the disclosure should, therefore, be determined not with reference to the above description, but instead should be determined with reference to the pending claims along with their full scope or equivalents.

What is claimed is:

1. A beverage dispensing apparatus including a lever assembly, the lever assembly comprising:

a base having a bottom configured to mate with a beverage dispensing device, a top side opposite the bottom and apertures penetrating the base from top to bottom configured to align with buttons on the beverage dispensing apparatus; and, at least one elongated lever having a top surface, a bottom surface, a first end and a second end configured to extend away from the centerline of the beverage dispensing apparatus;

wherein when the lever assembly is installed on the beverage dispensing apparatus, buttons extending from the top of the beverage dispensing apparatus extend up through the apertures, pressing against the bottom surface of the at least one elongated lever, biasing the at least one lever upward and the when the lever is pressed, the lever pushes against the button of the beverage dispensing apparatus to dispense a beverage, and wherein the base comprises two pin mounts.

2. The lever assembly of claim 1 further comprising a pin extending between the two pin mounts.

3. The lever assembly of claim 2 wherein the second end of the at least one elongated lever is configured to mate with and rotate about the pin.

4. The lever assembly of claim 3 further comprising a rotation stop arm extending from the top surface at the second end of the at least one elongated lever.

5. The lever assembly of claim 4 further comprising a stop surface aligned across from and coordinating with the rotation stop arm, wherein the biasing of the lever upward and about the pin is limited by the rotation stop arm contacting the stop surface.

6. The lever assembly of claim 5, wherein the second end of the at least one elongated is configured to coordinate and mate with one additional elongated lever and where the stop surface of each elongated lever is the top surface of the other elongated lever.

7. The lever assembly of claim 6, wherein the beverage dispensing device comprises a bar gun elongated along a length and wherein the levers are configured to extend transverse to the length of the bar gun.

8. The lever assembly of claim 6, wherein the beverage dispensing device comprises a bar gun elongated along a length and wherein the levers are configured to extend parallel to the length of the bar gun.

* * * * *